US005310074A

United States Patent [19]

Jochem et al.

[11] Patent Number: 5,310,074

[45] Date of Patent: May 10, 1994

[54] CANISTER WITH LID-RELEASE CONTROL MECHANISM

[75] Inventors: David J. Jochem, Evansville, Ind.; Timmy L. Willett, Waverly, Ky.

[73] Assignee: Berry Plastics Corporation, Evansville, Ind.

[21] Appl. No.: 82,982

[22] Filed: Jun. 25, 1993

[51] Int. Cl.[5] ..... B65D 55/02

[52] U.S. Cl. ..... 220/296; 215/223

[58] Field of Search ..... 215/223, 222, 217, 218; 220/296, 293, 297, 298

[56] References Cited

U.S. PATENT DOCUMENTS 3,510,021 5/1970 Silver .
3,656,647 4/1972 Swinn .
3,684,117 8/1972 Leopoldi et al. .
3,741,421 6/1973 Wittwer .
3,794,200 2/1974 Marks .
3,841,514 10/1974 Montgomery et al. .
3,858,741 1/1975 Smith, Sr. .
3,881,623 5/1975 Landen .
3,884,379 5/1975 Landen .
3,885,696 5/1975 Eberhardt ..... 220/296
3,888,376 6/1975 Cooke .
3,891,110 6/1975 Gach .
3,894,647 7/1975 Montgomery .
3,941,268 3/1976 Owens et al. .
3,967,745 7/1976 Julian .
3,971,487 7/1976 Montgomery .
3,974,929 8/1976 Montgomery .
3,989,152 11/1976 Julian .
3,998,355 12/1976 Galer .
4,014,452 3/1977 Galer .
4,034,886 7/1977 Galer .
4,036,385 7/1977 Morris .
4,059,198 11/1977 Mumford .
4,099,639 7/1978 Boxer et al. .
4,105,132 8/1978 Keeler .
4,116,351 9/1978 Uhlig .
4,134,513 1/1979 Mumford .
4,138,028 2/1979 Price et al. .
4,144,983 3/1979 Pauls et al. .
4,149,646 4/1979 Julian .
4,154,353 5/1979 Hoo .
4,172,533 10/1979 Montgomery .
4,203,524 5/1980 Wieland .
4,213,534 7/1980 Montgomery .
4,260,067 4/1981 Andruchiw .
4,270,664 6/1981 Buono .
4,298,129 11/1981 Stull ..... 220/296
4,331,247 5/1982 Mumford .
4,335,823 6/1982 Montgomery et al. .
4,341,318 7/1982 Smalley .
4,345,690 8/1982 Hopley .
4,360,113 11/1982 Luker .
4,365,721 12/1982 Montgomery .
4,375,858 3/1983 Shah et al. .
4,375,859 3/1983 Fillmore ..... 215/223
4,376,497 3/1983 Mumford .
4,385,711 5/1983 Bowen .
4,402,416 9/1983 Mumford et al. .
4,410,097 10/1983 Kusz .
4,413,742 11/1983 Sandhaus .
4,413,743 11/1983 Summers .
4,427,124 1/1984 Marshall et al. .
4,436,211 3/1984 Gach .
4,442,945 4/1984 Sandhaus .
4,452,363 6/1984 Davis .
4,454,955 6/1984 Kusz et al. .
4,456,136 6/1984 Palsson .
4,471,878 9/1984 Davis et al. .
4,479,585 10/1984 Sandhaus .
4,480,759 11/1984 Behrens et al. .
4,511,049 4/1985 Aboud .

(List continued on next page.)

*Primary Examiner*—Joseph Man-Fu Moy
*Attorney, Agent, or Firm*—Barnes & Thornburg

[57] ABSTRACT

A container includes a lid for covering the open mouth of a container. The container includes a rim around the open mouth and a pair of helical lid guides apended to the rim. The lid is rotatable to engage the helical lid guides and retain the lid in place on the container. The lid includes a first guide follower that is arranged to move around the rim during rotation of the lid relative to the container and engage one of the lid guides to hold the lid on the container.

29 Claims, 4 Drawing Sheets

U.S. PATENT DOCUMENTS 4,523,688 6/1985 Puresevic et al. .
4,540,098 9/1985 Luker .
4,548,329 10/1985 Curry .
4,567,991 2/1986 Anderson .
4,572,385 2/1986 Luker .
4,579,238 4/1986 Herr .
4,579,239 4/1986 Hart .
4,588,097 5/1986 Hauser .
4,605,135 8/1986 Ryder .
4,609,114 9/1986 Roy .
4,630,743 12/1986 Wright .
4,653,672 3/1987 Tuerk et al. .
4,664,273 5/1987 Simon .
4,667,836 5/1987 McLaren .
4,682,700 7/1987 Montgomery et al. .
4,687,112 8/1987 Swartzbaugh .
4,694,968 9/1987 Proctor et al. ..... 215/223
4,709,822 12/1987 Vataru .
4,723,677 2/1988 Nagel, Jr. .
4,732,288 3/1988 Morris, Sr. .
4,752,013 6/1988 Miller et al. .
4,752,014 6/1988 House et al. .
4,775,062 10/1988 Carle et al. .
4,865,209 9/1989 Bush .
4,876,003 10/1989 Casberg .
4,913,299 4/1990 Petro .
4,940,167 7/1990 Fillmore et al. .
4,948,002 8/1990 Thornock et al. .
4,957,210 9/1990 Kusz .
4,961,512 10/1990 Von Holdt .
4,967,926 11/1990 Morris, Sr. .
4,991,729 2/1991 Hunter .
4,991,733 2/1991 Marino .
4,997,096 3/1991 Kusz .
5,020,681 6/1991 Kusz .
5,058,754 10/1991 Hickerson .
5,152,416 10/1992 Cassel ..... 220/296
5,197,621 3/1993 Bartl et al. ..... 220/296

TO OPEN
TO CLOSE
4
4

CANISTER WITH LID-RELEASE CONTROL MECHANISM

BACKGROUND AND SUMMARY OF THE INVENTION

This invention relates to containers with removable lids, and particularly, to a lid that is not easily removed from a container by a child. More particularly, this invention relates to a canister with a lid-release control mechanism.

Many consumers want a container lid that can be removed easily by an adult but not by a child. It is hoped that child-resistant closure and container assemblies will make it more difficult for unauthorized children to remove a lid from a container and gain access to the contents of the container.

One problem with some conventional child-resistant lids is that a tool must be used to remove the lid from the container. Another problem with some designs is that it is necessary to deform the container or lid to gain access to the material in the container. It has been observed that consumers are eager for an easy on-easy off lid that is not easily removed from a container by a young child and that is removable by an adult without first using a tool or deforming either the container or the lid.

What is needed is a lid that can be automatically installed on a container and removed manually by an adult aware of the technique that must be followed to detach the lid from the container. A lid that is configured to hide the container engaging and locking means from sight when installed on the container and to require only minimal movement relative to the container during installation and removal would avoid shortcomings of conventional child-resistant container lid systems.

According to the present invention, a canister includes a lid for covering the open mouth of a container. The container includes a rim around the open mouth and a pair of helical lid guides appended to the rim. The lid is rotatable to engage the helical lid guides and retain the lid in place on the container. The lid includes a first guide follower that is arranged to move around the rim during rotation of the lid relative to the container and engage one of the lid guides to hold the lid on the container.

A first of the helical lid guides on the container rim includes a first stop face. The lid further includes a first lock tab for engaging the first stop face on the first helical lid guide to block continued rotation of the lid in the lid-removal direction during removal of the lid from the container. The lid also includes handgrip means for lifting the first lock tab away from the container to disengage the first stop face on the first helical lid guide. The barrier to rotation of the lid relative to the container is removed once the first lock tab disengages the first stop face. The handgrip means allows an operator to move the tab to a position above the first helical lid guide disengaging the first lock tab and the first stop face so that continued rotation of the lid relative to the container in the lid-removal direction is permitted.

In preferred embodiments, the second helical lid guide on the container rim has a second stop face. The lid also includes a second lock tab on the second helical lid guide for engaging the second stop face on the second helical lid guide to block continued rotation of the lid in the lid-removal direction during removal of the lid. The first and second lock tabs are located about the periphery of the lid so that during rotation of the lid the first lock tab engages the first stop face on the container at the same time that the second lock tab engages the second stop face on the container. Such engagement prevents an operator from turning the lid any further relative to the container in the lid-removal direction. Essentially, this barrier helps to prevent many unauthorized persons from removing the lid to open the container.

To remove the lid from the container, the operator must first know that the handgrip means on the lid must be used to lift the first and second lock tabs away from the container to disengage those lock tabs on the lid and the stop faces on the container and thereby take away the lid rotation barrier set up by the lock tabs and the stop faces. Once the lid has been lifted in this manner, the operator is once again able to begin rotating the lid relative to the container in the lid-removal direction until the lid is removed from the container.

Advantageously, the lid-release control mechanism of the present invention is applicable to a wide variety of container and lid assemblies. The lid-release control mechanism can be used to provide a limited access lidded container that can be opened easily by an adult without using a tool or deforming the container or lid. Also, the design allows the container to be lidded automatically during a container-filling process. Minimal rotation of the lid relative to the container is needed to engage and disengage the guide followers on the lid and the lid guides on the container.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 2:
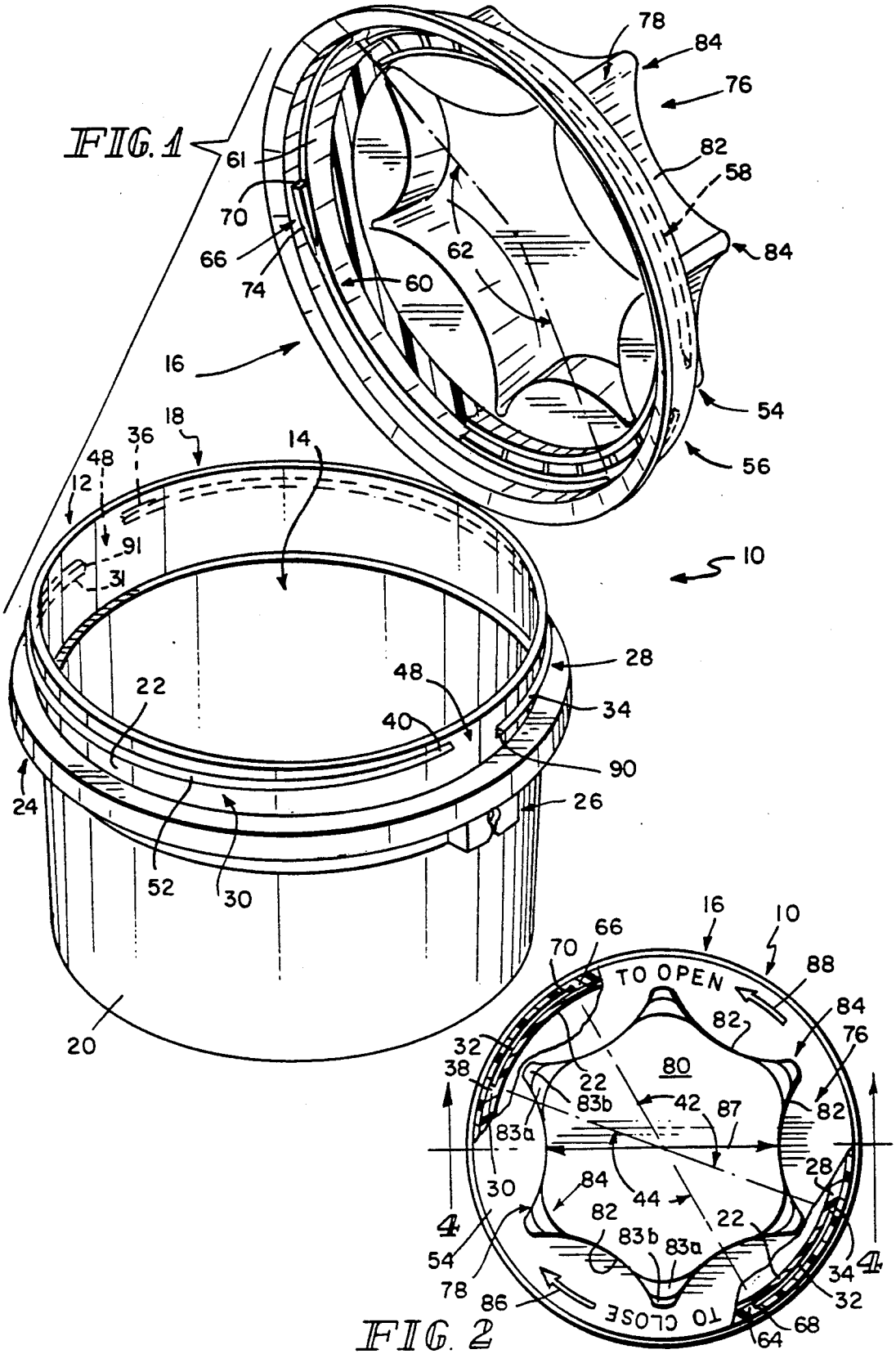
FIG. 1 is a perspective view of a canister in accordance with the present invention showing an open container with first and second helical lid guide on the rim and a matching lid with first and second guide followers, a first lock tab on the first guide follower, and a second lock tab on the second guide follower.
FIG. 2 is a top plan view of the lid of FIG. 1 after installation of the lid on the container, with portions broken away to show engagement of the first lock tab on the first guide follower and a first stop face on the first lid guide and concurrent engagement of the second lock tab on the second guide follower and a second stop face on the second lid guide.

A canister 10 includes a container 12 formed to include a product-receiving chamber 14 and a removable lid 16 configured to mount on top of the container 12 and cover the open mouth 18 of the container 12 as shown in FIG. 1. A novel lid-release control mechanism is formed partly on container 12 and partly on lid 16 to limit the ability of unauthorized persons to remove the lid 16 from the container 12 and gain access to any product (not shown) stored in chamber 14. Advantageously, this lid-release control mechanism is economical to manufacture and is applicable to a wide variety of canisters. An adult aware of the technique for actuating the lid-release control mechanism will be able to remove the rotatable lid 16 from the container 12 without using a tool or deforming the lid 16 or container 12.

As shown in FIG. 1, the container 12 includes a cylindrical rim 22 around open mouth 18, an annular lip 24 below the rim 22, and a pair of bail lugs 26 below lip 24. The container 12 also includes first and second lid guides 28, 30 formed on an exterior surface 32 of rim 22. These lid guides 28, 30 form one part of the lid-release control mechanism of the present invention.

Illustratively, the container 12 is molded as a single piece using a plastics materials such as a high density polyethylene. Such material is characterized by toughness, near zero moisture absorption, excellent chemical resistance, excellent electrical insulating properties, low coefficient of friction, and ease of processing. The lid 16 is also a one piece molded part made out of the same material as the container 12.

As shown best in FIG. 1, the first lid guide 28 is a helical segment that winds around a c-shaped portion of the exterior surface 32 of annular rim 24. The first lid guide 28 includes a trailing end portion 34 at one end and a leading end portion 36 at the opposite end. The second lid guide 30 is likewise a helical segment that winds around an opposite c-shaped portion of the exterior surface 32 of annular rim 24. The second lid guide 30 includes a trailing end member 38 at one end and a leading end member 40 at the opposite end. Illustratively, the first helical segment 28 has a central angle 42 of about 171° and the second helical segment 30 has a central angle 44 of about 171° as shown in FIG. 2.

The first and second lid guides 28, 30 are inclined on the rim 22 to position the leading end member 40 of the second lid guide 30 vertically above the trailing end portion 34 of the first lid guide 28. A first lock tab channel 46 is formed in the space between the leading end member 40 and the trailing end portion 34 as shown best in FIGS. 1, 3 and 4. Illustratively, the leading end member 40 and the trailing end portion 34 are situated to lie in circumferentially spaced-apart relation to one another.

The incline of the first and second lid guides 28, 30 also causes the leading end portion 36 of the first lid guide 28 to lie in a position vertically above the trailing end member 38 of the second lid guide 30 so as to define a second lock tab channel 48 therebetween as shown in FIG. 1. Illustratively, the leading end portion 36 and the trailing end member 28 are situated to lie in circumferentially spaced-apart relation to one another. As shown best in FIGS. 2, 8, and 9, each lid guide 28, 30 also includes an elongated curved downwardly facing edge 50, 52, respectively. Portions of the lid 16 engage these downwardly facing edges 50, 52 to retain the lid 16 in place on the container 12.

The lid 16 includes a top portion 54 covering the open mouth 18 and a downwardly extending cylindrical side wall 56 around top portion 54. A pair of guide followers 58, 60 are formed on an interior surface 61 of side wall 56 to engage the first and second lid guides 28, 30 and retain the lid 16 in place on the container 12 as shown in FIG. 1. Illustratively, each guide follower 58, 60 is a curved segment having a central angle 62 of about 171° as shown in FIG. 1.

A first lock tab 64 is formed on a middle section of the curved first guide follower 58 and a second lock tab 66 is formed on a middle section of the curved first guide follower 60. Illustratively, the first and second lock tabs 64, 66 lie about 180° apart on the interior surface 61 of the cylindrical side wall 56 of lid 16. The first and second lock tabs 64, 66 function to limit rotation of the lid 16 relative to container 12 in a lid-removal direction in the manner outlined below and thus function as part of the novel lid-release control mechanism.

The first lock tab 64 includes a flat vertical blocking face 68 shown, for example, in FIGS. 2, 4–7, 8, and 9 and the second lock tab 62 includes a flat vertical blocking face 70 shown, for example, in FIG. 1. These blocking faces 68, 70 are oriented to engage the lid guides 28, 30 at a particular point during rotation of lid 16 in a lid-removal direction relative to the container 12 to impede removal of the lid 16 from the container 12. The first lock tab 64 also includes a ramp 72 and second lock tab 66 also includes a ramp 74.

Figure 3:
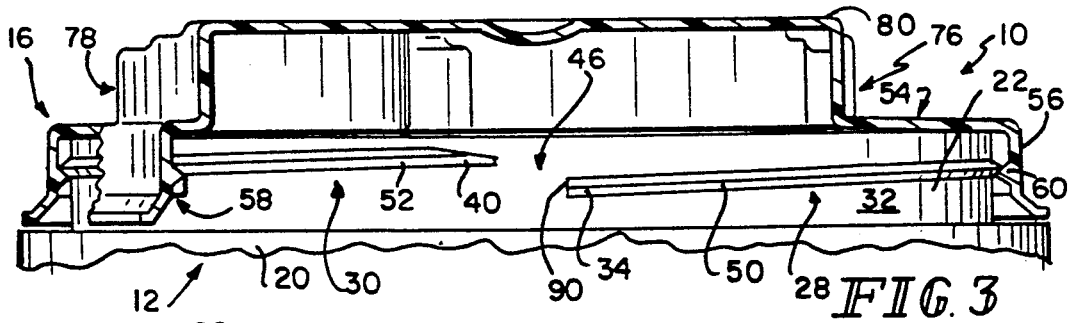
FIG. 3 is a side elevation of the canister of FIG. 2 showing the top of the container in full and portions of the lid in section while the lid is retained in a "locked" position on the container.

The lid 16 also includes an upstanding handle 76 formed in the center of top portion 54 as shown best in FIGS. 1, 2, and 3. Handle 76 includes a scalloped annular grip portion 78 and a flat palm portion 80. The interdental spaces 82 around the periphery of scalloped grip portion 78 make it easy for an adult to grip the handle 76 and turn and lift the lid 16 relative to the underlying container 12. Ideally, the diameter 87 (FIG. 2) of the handle 76 is greater than or equal to 4.22 inches (10.71 cm) to make it difficult for a child to grip, turn, and/or lift the handle 76 to operate and remove the lid 16 from the container 12.

Figure 10:
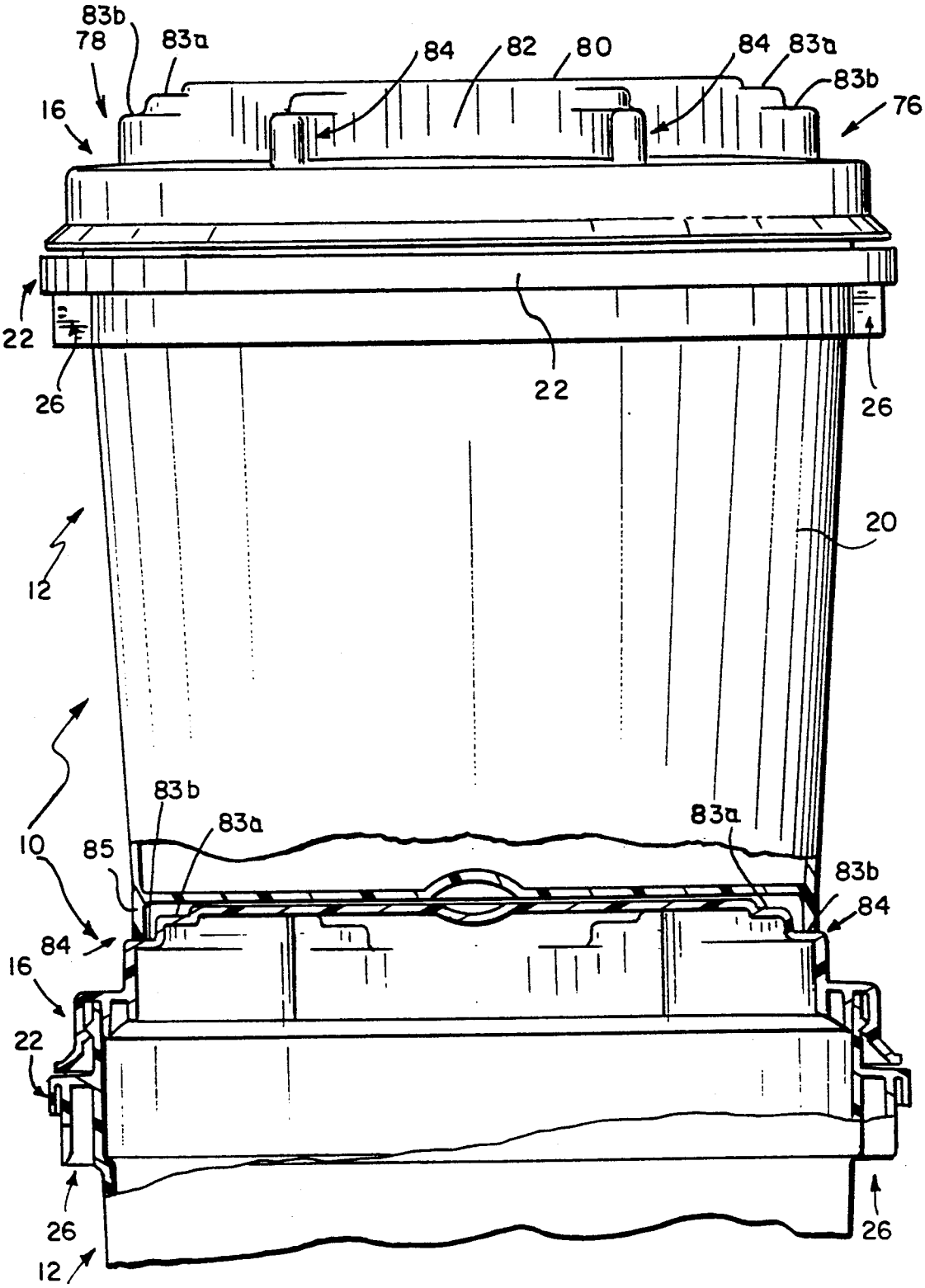
FIG. 10 is a view of a pair of canisters as shown in FIG. 1 wherein one of the canisters is stacked on top of the other of the canisters.

As shown best in FIGS. 2 and 10, the handle 76 is also formed to include a plurality of radially outwardly extending steps 83*a, b* on each handle lobe 84 about the periphery of handle 76. These steps make it easier to nest one lid 16 inside another lid 16 (not shown) and to stack one canister 10 on top of another canister 10 as shown in FIG. 10. Illustratively, a circular ring 85 is formed on the bottom of container 12 and sized so that it engages one of the sets of steps 83 a, b on the handle lobes 84 when one container 12 is stacked on top of the lid 16 of an underlying container 12.

Figure 4:
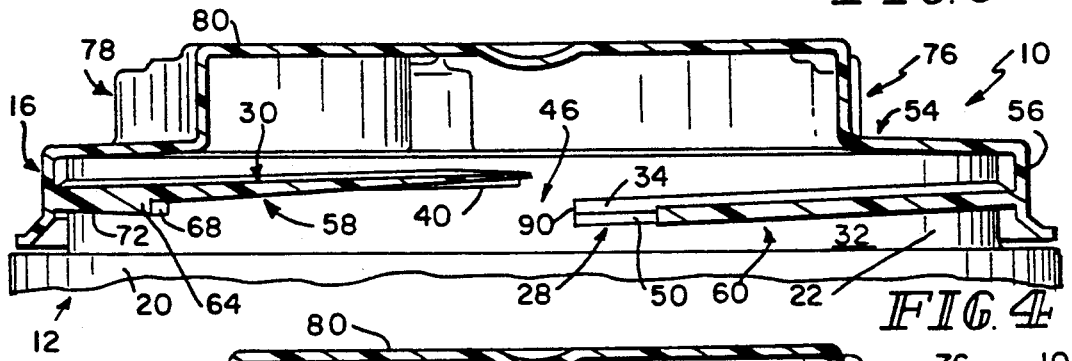
FIG. 4 is a view that is taken along lines 4—4 of FIG. 2 and that is identical to FIG. 3 except that additional portions of the lid are removed to show the first lock tab on the first guide follower more clearly and to show the location of the second guide follower relative to the first guide follower.

In use, the lid 16 is screwed onto container 12 in a clockwise direction just as a normal lid would be mounted on a container. Once the guide followers 58, 60 engage the downwardly facing edges 50, 52 on the first and second lid guides 28, 30 and the lid 16 has been turned about one-half of a turn (or until tight), there is nearly full engagement of the guide followers 58, 60 of the lid 16 and the lid guides 28, 30 of the container 12 and the lid 16 is retained in place on the container 12 as shown in FIGS. 3 and 4. To close the lid 16, the lid 16 is rotated in a clockwise direction 86 as noted in the printed instructions formed on the top portion 54 of lid 16 around the scalloped grip portion 78 of handle 76 as shown in FIG. 2.

Figure 5:
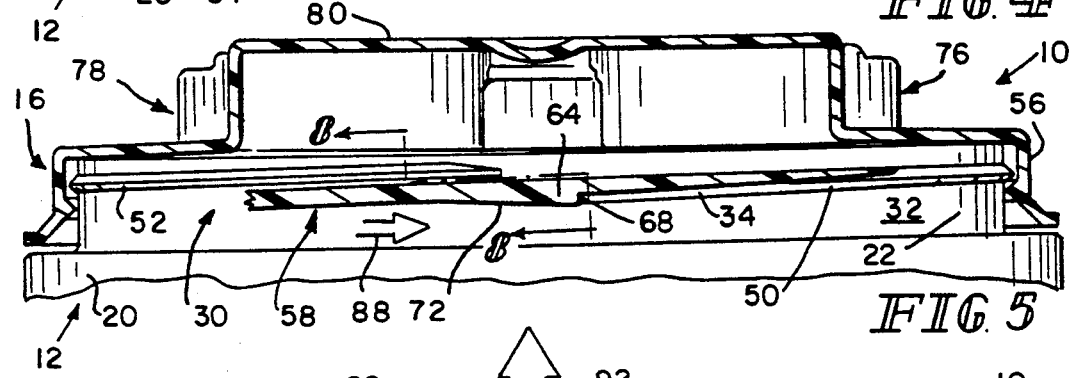
FIG. 5 is a view similar to FIG. 4 but showing the position of the lid after it has been rotated in a lid-removal direction to cause the first lock tab on the first guide follower to engage the first stop face on the first lid guide, thereby blocking further rotation of the lid relative to the container in the lid-removal direction.
Figure 8:
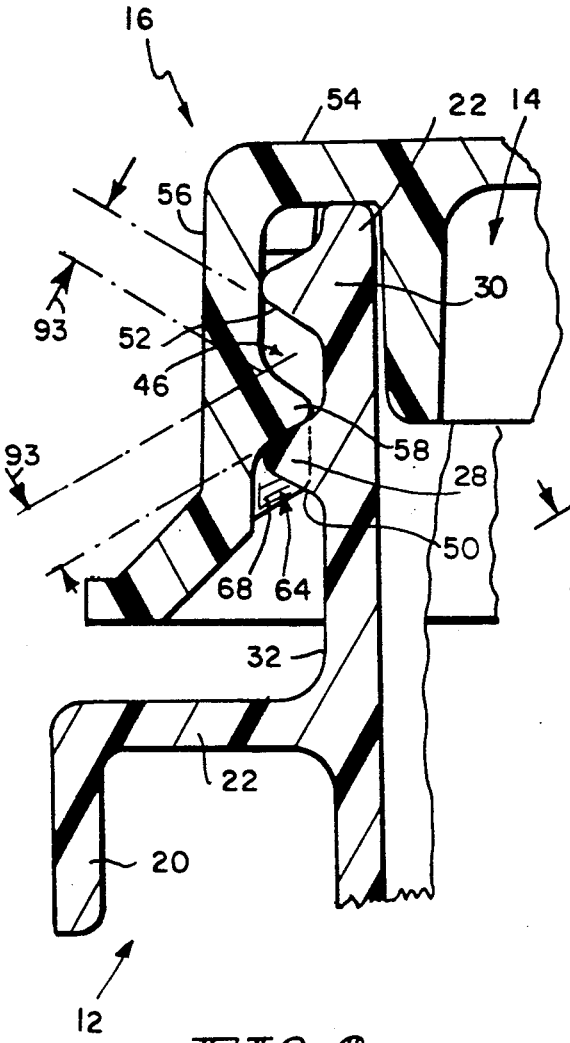
FIG. 8 is an enlarged sectional elevation view taken along line 8—8 of FIG. 5 showing the engagement of the first lock tab of the first guide follower and the first lid guide and showing the location of a portion of the second lid guide above the first lid guide.

To open the canister 10, one must turn the lid 16 in a counterclockwise direction 88 relative to container 12 until the lid 16 automatically comes to a stop. The two lock tabs 66, 68 are located 180° apart on the lid and extend downwardly toward container 12 so that the flat blocking faces 68, 70 will engage flat stop-faces provided on the lid guides 28, 30 to create a positive stop. For example, as shown in FIGS. 4 and 5, rotation of lid 16 in counterclockwise direction 88 will cause the second lock tab 64 to rotate about the annular container rim 22 until the second blocking face 70 engages the first stop face 90 formed on the trailing end portion 34 of first lid guide 28. This engagement establishes a barrier to further rotation of lid 16 relative to container 12 in a counterclockwise lidremoval direction 88. This rotation-blocking engagement is also shown in FIG. 8. A second stop face 91 is formed on the trailing end member 38 of second lid guide 30 for engaging the first blocking face 68 on the first lock tab 64 at the same time that second blocking face 70 engages first stop face 90.

Figure 6:
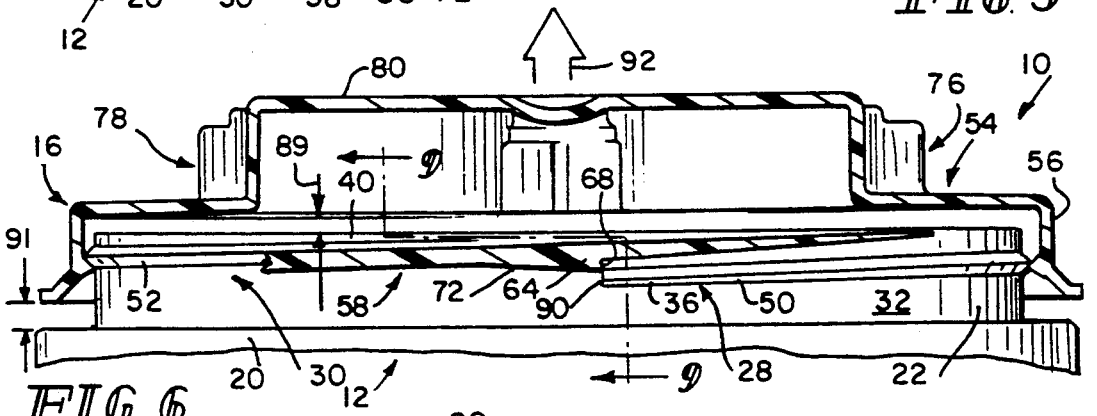
FIG. 6 is a view similar to FIG. 5 but showing the lid after it has been lifted away from the container manually by an operator using the handgrip portion on top of the lid so that the first lock tab is moved to a position above the first lid guide disengaging the first stop face.
Figure 7:
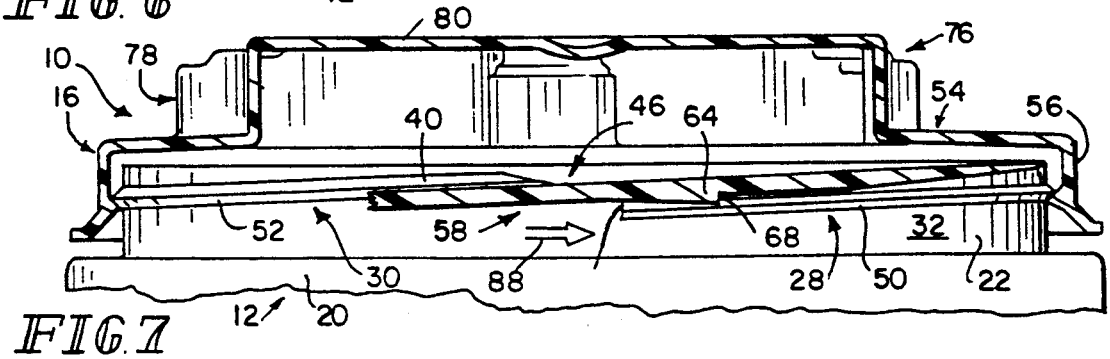
FIG. 7 is a view similar to FIG. 6 but showing the lid after it has been rotated further in the lid-removal direction.

Only by manually lifting the lid 16 a distance 91 in direction 92 as shown in FIG. 6 using handle 76 can one begin to remove the lid 6 from the container 12. As shown partly in FIG. 6, such lifting moves the first and second lock tabs 66, 68 upwardly away from container 12 to cause the first and second blocking faces 68, 70 to disengage the first and second stop faces 90, 91. By lifting both locking tabs 68, 70 simultaneously, it is possible for these locking tabs 68, 70 to pass through the first and second lock tab channels 46, 48 and make the transition from engagement with the stop faces 90, 91 on lid guides 28, 30 to a position vertically above the lid guides 28, 30 as shown in FIG. 6. Such lifting allows an operator to resume unscrewing the lid 16 by rotating it relative to container 12 in the counterclockwise lid-removal direction 88 as shown in FIG. 7 until the lid 16 is removed from the underlying container 12.

Figure 9:
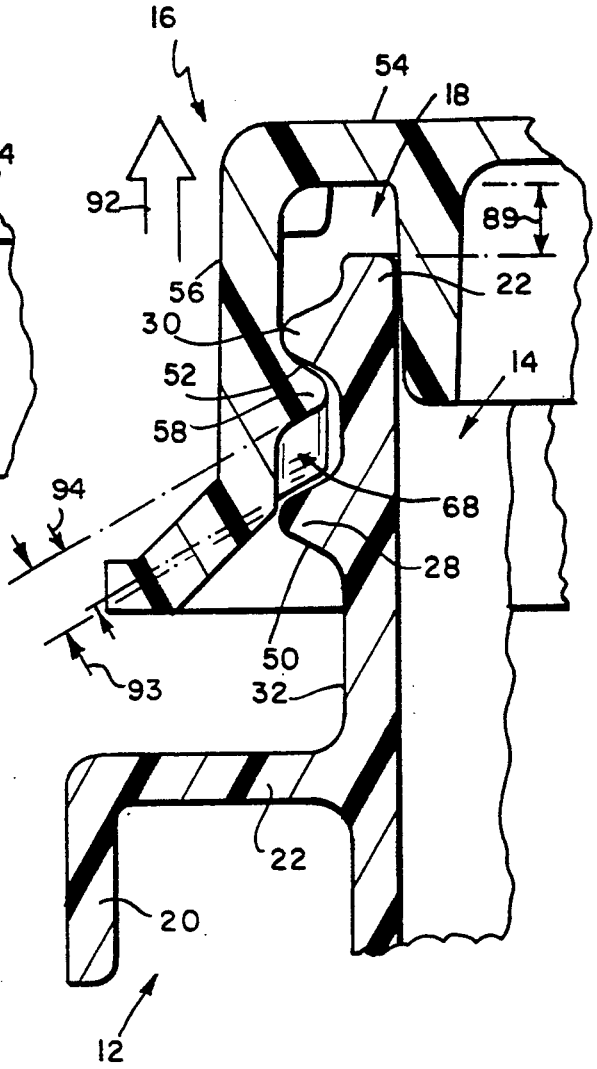
FIG. 9 is an enlarged sectional elevation view taken along line 9—9 of FIG. 6 showing the free and clear position of the first lock tab of the after it has been lifted away from the container to disengage the first stop face on the first lid guide and positioned to pass through a first lock tab channel during continued rotation of the lid relative to the container in the lid-removal direction.

Movement of first lock tab 64 in first lock tab channel 46 is shown, for example, in FIGS. 8 and 9. In FIG. 8, the first blocking face 68 on first guide followers engages the first stop face 90 on first lid guide 28. As shown in FIG. 8, the effective width 93 of the first lock tab channel 48 is defined by the relative location and shape of the first and second lid guides 28, 30. As shown in FIG. 9, the effective width 94 of the first lock tab 64 is less than the effective width 93 of the first lock tab channel 48 so that the user is able to lift the handle 76 and move the first blocking face 68 to disengage the first stop face 90 and lie above the first lid guide 28.

Preferably, the two lock tabs 64, 66 are located and sized to be hidden from view by the lid 16 once the lid 16 is mounted on the container 12. As such, the container and lid assembly 10 does not reveal the location and character of the locking means in the lid-release user control mechanism. This makes it necessary for a to read lid removal directions printed on the lid 16 or else know in advance how the lid 16 is removed.

The pair of lid guides 28, 30 are curved and arranged to aid in attaining the maximum effective engagement length with the guide followers 58, 60 per revolution of the lid 16. Advantageously, once the guide followers 58, 60 engage the downwardly facing edges 50, 52 of the lid guides 28, 30, one is able to achieve approximately 360° of lid/container engagement with only one-half turn of lid 16 in the clockwise lid-installing direction 66.

In the illustrated embodiment, the handle 76 must be lifted in its middle due to the location of the first and second lock tabs 64, 66 180° apart around the periphery of lid 16. Essentially, the lid 16 must be lifted in direction 92 so that both lock tabs 64, 66 are free to bypass the flat stop faces 90, 91 on the lid guides 28, 30 at the same time. If only one side of the lid 16 is lifted, then only one side is free to turn but the opposing side (180° apart) is still locked/

Illustratively, the handle 76 is sized so that it is large enough to inhibit a small child (42-51 months) from being able to get his or her hand around it but not so large that a senior citizen could not grip, turn, and lift the handle 76. Moreover, the scalloped design actually conforms to the hand of the user.

The handle lobes 84 are spaced about 60° apart (6 places) around the handle 76 to provide a user with an additional mechanical advantage when installing and removing the lid 16. These lobes 84 also include steps 83*a, b* to allow these lobes 84 to act as stacking lugs which enhance the nestability of lid 16 for more practical storage, filling, and transportation. Also, the lid 16 is configured so that it does not allow for water to collect so as to protect the contents of canister 10 from moisture.

Although the invention has been described in detail with reference to certain preferred embodiments, variations and modifications exist within the scope and spirit of the invention as described and defined in the following claims.

We claim:

1. A canister for holding a product, the canister comprising a container formed to include a productreceiving chamber having an open mouth, a rim around the open mouth, a first lid guide having a leading end portion at one end and a trailing end portion at an opposite end, and a second lid guide having a leading end member at one end and a trailing end member at an opposite end, the first and second lid guides being helical in shape and appended to the rim to lie about the rim in series, the first and second lid guides being inclined on the rim to position the leading end member of the second lid guide vertically above the trailing end portion of the first lid guide in a location between the open mouth of the product-receiving chamber and the trailing end portion of the first lid guide to define a first lock tab channel therebetween, and to position the leading end portion of the first lid guide vertically above the trailing end member of the second lid guide in a location between the open mouth of the productreceiving chamber and the trailing end member of the second lid guide to define a second lock tab channel therebetween, and a lid including closure means for closing the open mouth of the product-receiving chamber and engagement means for rotatably engaging the first and second lid guides to retain the closure means on the container, the engagement means including first guide follower means for following a first helical path established by the first and second lid guides during rotation of the lid in a lid-removal direction about an axis of rotation and first lock tab means for engaging the trailing end portion of the first lid guide during rotation of the lid in the lid-removal direction to block further rotation of the lid relative to the container, the closure means including handgrip means for lifting the engagement means away from the container once the first lock tab means engages the trailing end portion of the first lid guide to pass the first lock tab means upwardly through the first lock tab channel so that the first lock tab means disengages the trailing end portion of the first lid guide and moves to a position above the first lid guide to permit continued rotation of the lid in the lid-removal direction relative to the container.

2. The canister of claim 1, wherein the first lock tab means is appended to the first guide follower means.

3. The canister of claim 2, wherein the first guide follower means is positioned to lie between the handgrip means and the first lock tab means.

4. The canister of claim 2, wherein the closure means includes a top wall and a cylindrical side wall appended to the top wall, the handgrip means is appended to the top wall, and the first guide follower means is appended to the cylindrical side wall.

5. The canister of claim 4, wherein the cylindrical side wall includes a bottom edge and the first lock tab means is appended to the cylindrical side wall and arranged to lie in position between the top wall of the closure means and the bottom edge of the cylindrical side wall.

6. The canister of claim 1, wherein the leading end member of the second lid guide is positioned to lie in circumferentially spaced-apart relation to the trailing end portion of the first lid guide and the leading end portion of the first lid guide is positioned to lie in spaced-apart relation to the trailing end member of the second lid guide.

7. The canister of claim 1, wherein the handgrip means includes a palm portion and a grip portion around the palm portion and the palm portion has an outer diameter that is at least 4.22 inches (10.71 cm).

8. The canister of claim 7, wherein the grip portion is fluted to provide a plurality of fingerreceiving interdental spaces around the palm portion.

9. The canister of claim 1, wherein the first guide follower means includes a first rail having a pair of spaced-apart distal ends and the first lock tab means is arranged to lie on the rail midway between the pair of spaced-apart distal ends.

10. The canister of claim 9, wherein the first rail includes a bottom edge facing downwardly toward the underlying container and the first lock tab means is appended to the bottom edge of the first rail and configured to project downwardly away from the bottom edge of the first rail.

11. The canister of claim 10, wherein the first lock tab means includes a first stop face arranged to lie underneath the bottom edge of the first rail and engage the trailing end portion of the first lid guide upon arrival of the first lock tab means in the first lock tab channel between the first and second lid guides.

12. The canister of claim 10, wherein the first lid guide includes a top edge facing upwardly toward the closure means and extending between the leading end portion and the trailing end portion, and the first lock tab means includes a bottom surface confronting and lying above the top edge of the first lid guide during continued rotation of the lid in the lidremoval direction after disengagement of the first lock tab means and the trailing end portion of the first lid guide.

13. The canister of claim 1, wherein the first guide follower means includes a bottom edge facing downwardly toward the underlying container and the first lock tab means is appended to the bottom edge and configured to project downwardly away from the bottom edge.

14. The canister of claim 13, wherein the first lock tab means includes a first stop face arranged to lie underneath the bottom edge and engage the trailing end portion of the first lid guide upon arrival of the first lock tab means in the first lock tab channel between the first and second lid guides.

15. The canister of claim 14, wherein the first lock tab means further includes a ramp arranged to lie underneath the bottom edge and extend between the bottom edge and the first stop face and face in a direction away from the trailing end portion of the first guide lid.

16. The canister of claim 1, wherein the engagement means further includes second guide follower means for following a second helical path established by the second and first lid guides during rotation of the lid in the lid-removal direction about the axis of rotation and second lock tab means for engaging the trailing end member of the second lid guide during rotation of the lid in the lid-removal direction to block further rotation of the lid relative to the container so that the second lock tab means passes upwardly through the second lock tab channel and disengages the trailing end member of the second lid guide concurrently with disengagement of the first lock tab means and the trailing end portion of the first lid guide and moves to a position above the second lid guide in response to use of the handgrip means to lift the engagement means to permit continued rotation of the lid in the lid-removal direction relative to the container.

17. The canister of claim 16, wherein the first guide follower means includes a first bottom edge facing downwardly toward the underlying container and the first lock tab means is appended to the first bottom edge and configured to project downwardly away from the first bottom edge, the second guide follower means includes a second bottom edge facing downwardly toward the underlying container, and the second lock tab means is appended to the second bottom edge and configured to project downwardly away from the second bottom edge.

18. The canister of claim 17, wherein the first lock tab means includes a first stop face arranged to lie underneath the first bottom edge and engage the trailing end portion of the first lid guide upon arrival of the first lock tab means in the first lock tab channel between the first and second lid guides, and the second lock tab means includes a second stop face arranged to lie underneath the second bottom edge and engage the trailing end member of the second lid guide upon arrival of the second lock tab means in the second lock tab channel between the first and second lid guides.

19. A canister for holding a product, the canister comprising a container formed to include a productreceiving chamber having an open mouth, a rim around the open mouth, a helical first lid guide on the rim, and a helical second lid guide on the rim, the first lid guide including a first stop face, the second lid guide including a second stop face, and a lid including closure means for closing open mouth of the product-receiving chamber and engagement means for rotatably engaging the first and second lid guides to retain the closure means on the container, the engagement means including first and second guide followers positioned to move around the rim between the first and second lid guides during rotation of the lid relative to the container, the first guide follower including first lock tab means for engaging the first stop face on the first lid guide to block continued rotation of the lid relative to the container in a lidremoval direction, the second guide follower including second lock tab means for engaging the second stop face on the second lid guide to block continued rotation of the lid relative to the container in the lid-removal direction, the lid further including handgrip means for lifting the first and second guide followers away from the container to disengage the first and second stop faces so that continued rotation of the lid relative to the container in the lid-removal direction is permitted.

20. The canister of claim 19, wherein the first guide follower is positioned to lie between the handgrip means and the first lock tab means and the second guide follower is positioned to lie between the handgrip means and the second lock tab means.

21. The canister of claim 19, wherein the closure means includes a top wall and a cylindrical side wall appended to the top wall, the handgrip means is appended to the top wall, and the first and second guide followers are appended to the cylindrical side wall.

22. The canister of claim 21, wherein the first guide follower is a curved segment having a central angle of 171° and the second guide follower is a separate curved segment having a central angle of 171°.

23. The canister of claim 22, wherein each of the first and second guide followers is helical.

24. The canister of claim 22, wherein the first guide follower includes a pair of spaced-apart distal ends, the first lock tab means is arranged to lie about midway between the distal ends of the first guide follower, the second guide follower includes a pair of spaced-apart distal ends, and the second lock tab means is arranged to lie midway between the distal ends of the second guide follower.

25. The canister of claim 19, wherein the first guide follower includes a first bottom edge facing downwardly toward the underlying container, the first lock tab means is appended to the first bottom edge and configured to project downwardly away from the first bottom edge, the second guide follower includes a second bottom edge facing downwardly toward the underlying container, and the second lock tab means is appended to the second bottom edge and configured to project downwardly away from the second bottom edge.

26. The canister of claim 25, wherein each of the first and second bottom edges is helical.

27. The canister of claim 19, wherein the first lid guide has a leading end portion at one end and a trailing end portion at the other end, the second lid guide has a leading end member at one end and a trailing end member at an opposite end, the trailing end portion of the first lid guide defines the first stop face, and the trailing end member of the second lid guide defines the second stop face.

28. The canister of claim 27, wherein the leading end member of the second lid guide is positioned to lie vertically above the trailing end portion of the first lid guide in a location between the open mouth of the product-receiving chamber and the trailing end portion of the first lid guide and the leading end portion of the first lid guide is positioned to lie vertically above the trailing end member of the second lid guide in a location between the open mouth of the product-receiving chamber and the trailing end member of the second lid guide.

29. The canister of claim 27, wherein the leading end member of the second lid guide is positioned to lie in circumferentially spaced-apart relation to the trailing end portion of the first lid guide and the leading end portion of the first lid guide is positioned to lie in spaced-apart relation to the trailing end member of the second lid guide.

* * * * *